US007155955B2

(12) United States Patent
Bowles et al.

(10) Patent No.: US 7,155,955 B2
(45) Date of Patent: Jan. 2, 2007

(54) CRIMPING ASSEMBLY

(75) Inventors: Richard R Bowles, Solon, OH (US); James E Hamm, Grafton, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/238,329

(22) Filed: Sep. 10, 2002

(65) Prior Publication Data

US 2003/0046973 A1 Mar. 13, 2003

Related U.S. Application Data

(60) Provisional application No. 60/318,804, filed on Sep. 11, 2001.

(51) Int. Cl.
*B21D 41/04* (2006.01)
*B21D 39/00* (2006.01)

(52) U.S. Cl. ..... 72/453.16; 72/416; 72/407

(58) Field of Classification Search ..... 72/410, 72/416, 453.15, 453.16, 402, 452.8, 452.15, 72/452.16, 433.16; 29/237
See application file for complete search history.

(56) References Cited

U.S. PATENT DOCUMENTS

| | | | | |
|---|---|---|---|---|
| 5,148,698 | A | 9/1992 | Dischler | 72/410 |
| 5,335,531 | A | 8/1994 | Mann et al. | 72/416 |
| 5,598,732 | A | 2/1997 | Dischler | 72/292 |
| 5,611,236 | A | 3/1997 | Grunwald | 72/409.01 |
| 5,619,883 | A | 4/1997 | Dischler | 72/400 |
| 5,720,199 | A | 2/1998 | Dischler | 72/453.03 |
| 5,824,906 | A | 10/1998 | Lohmann | 73/597 |
| 6,035,775 | A | 3/2000 | Nghiem | 100/43 |
| 6,044,681 | A | 4/2000 | Frenken | 72/292 |
| 6,044,686 | A | 4/2000 | Dischler | 72/402 |
| 6,164,106 | A | 12/2000 | Nghiem et al. | 72/20.1 |
| 6,202,290 | B1 | 3/2001 | Kewitz et al. | 29/701 |
| 6,244,085 | B1 | 6/2001 | Dummermuth | 72/31.1 |
| 6,378,194 | B1 | 4/2002 | Nghiem | 29/516 |

(Continued)

FOREIGN PATENT DOCUMENTS

| | | |
|---|---|---|
| CH | 687 368 | 11/1996 |

(Continued)

OTHER PUBLICATIONS

PCT International Search Report for Internation Application No. PCT/US 02/28662, mailed Dec. 12, 2002, 5-pages.

*Primary Examiner*—David Jones
(74) *Attorney, Agent, or Firm*—Locke Liddell & Sapp LLP

(57) ABSTRACT

A crimping assembly is disclosed. The assembly includes cam profiles on the ends of the arms. The cam profiles are engaged by the crimping tool and control the input force versus displacement of the tool. The cam profile includes a first portion defined by a radius, a second portion adjacent the first portion and defined by a non-linear equation, and a third portion adjacent the second portion and defined by a linear equation. The assembly further includes a passive mode of failure in the side plates. The arms of the assembly have a hardness greater than the side plates and have a maximum section height at their point of rotation for increasing their strength. The assembly further includes a leaf spring disposed between the arms and held therebetween by pins disposed in holes defined in the sides of the arms. A crimp ring having an increased diameter is disclosed for reducing the crimping force required to crimp 3-inch fittings.

17 Claims, 8 Drawing Sheets

U.S. PATENT DOCUMENTS

| | | | | |
|---|---|---|---|---|
| 6,434,998 | B1 * | 8/2002 | Amherd | 72/453.16 |
| 6,457,338 | B1 | 10/2002 | Frenken | 72/20.1 |
| 7,000,448 | B1 * | 2/2006 | Hamm et al. | 72/453.16 |
| 2001/0013243 | A1 | 8/2001 | Amherd | 72/416 |
| 2001/0032490 | A1 | 10/2001 | Goop | 72/416 |

FOREIGN PATENT DOCUMENTS

| | | |
|---|---|---|
| DE | 8900250 | 4/1989 |
| DE | 9314054 | 11/1993 |
| DE | 4446504 | 3/1996 |
| DE | 9405783 | 11/1996 |
| DE | 19631019 | 8/1997 |
| DE | 19854943 | 2/1999 |
| DE | 29908622 | 7/1999 |
| DE | 19854943 | 12/1999 |
| DE | 10106363 | 6/2002 |
| EP | 0 805 278 | 11/1997 |
| EP | 0 824 979 | 2/1998 |
| EP | 0 860 220 | 8/1998 |
| EP | 0 860 223 | 8/1998 |
| EP | 0 860 245 | 8/1998 |
| EP | 0 941 813 | 9/1999 |
| EP | 1 034 896 | 9/2000 |
| EP | 1 092 487 | 4/2001 |
| EP | 1 103 349 | 5/2001 |
| EP | 1 114 698 | 7/2001 |
| EP | 1 142 655 | 10/2001 |
| GB | 891632 | 3/1962 |

* cited by examiner

60a

60b

60c

60d

60e

60f

CRIMPING ASSEMBLY

CROSS-REFERENCE TO RELATED APPLICATIONS

This application claims the benefit of the U.S. Provisional Application Ser. No. 60/318,804, filed Sep. 11, 2001.

FIELD OF THE INVENTION

The present invention relates generally to a crimping assembly for crimping a fitting to connect sections of pipe and, more particularly to a crimping assembly including an actuator assembly and a crimp ring.

BACKGROUND OF THE INVENTION

A crimp or press-style fitting is typically a tubular sleeve containing seals. The fitting is compressed in radial directions to engage the ends of pipes. The fitting forms a leak resistant joint between the pipe ends. The joint has considerable mechanical strength and is self-supporting. A crimping tool and crimping assembly are used to crimp the fitting. The crimping assembly can include jaws activated by the crimping tool for directly crimping the fitting. Alternatively, for larger fittings, the crimping assembly can be an actuator assembly having arms that actuate a crimp ring to crimp the fitting.

Referring to FIG. 1, components of a typical crimping tool 10, actuator assembly 18, and crimp ring 50 in accordance with the prior art are illustrated. The crimping tool 10 and actuator assembly 18 are shown partially unassembled to reveal relevant details. The crimping tool 10 includes a cylinder 12, a hydraulic piston 14, and an engagement member 16, such as a carriage having rollers 17. The actuator assembly 18 couples to the crimp tool 10 by methods known in the art. The actuator assembly 18 includes first and second actuator arms 20*a* and 20*b*, first and second side plates 40 and one not shown, and pivot pins 44.

Each actuator arm 20*a* and 20*b* includes a cam end 22 and a crimp end 24. The cam end 22 includes a surface 23 for contacting one of the rollers 17 of the engagement member 16 attached to the end of the hydraulic piston 14. The surfaces 23 of the prior art do not control the input force applied thereon by the rollers 17 versus displacement of the piston 14 when used with various fittings. Typically, the surfaces 23 of the prior art include a portion defined by a radius and include a portion defined by a line. In the present example, the crimp ends 24 of the arms 20*a* and 20*b* couple to the crimp ring 50 to crimp larger fittings.

The crimp ring 50 has a plurality of ring portions. In the present example, the crimp ring 50 has two portions 52*a* and 52*b* with each having an indentation 54 for receiving a crimp end 24 of the arms 20*a* and 20*b*. The portions 52*a* and 52*b* are pivotably connected together by a pin 56. The crimp ends 24 of the arms 20*a* and 20*b* couple respectively to the portions 52*a* and 52*b*.

In the prior art, the actuator arms 20*a* and 20*b* each define pockets 34, as best shown by the cross-section of arm 20*b*. The pocket 34 has two sidewalls 36 with one not shown in the cross-section of arm 20*b*. The two sidewalls 36 each define an indentation 36. The actuator assembly 18 includes a torsion spring 30 and a pin 32. The pin 32 disposes in the torsion spring 30. The spring 30 and pin 32 are positioned in the pockets 34 between the arms 20*a* and 20*b*. The pin 32 fits into the indentations 38 in the sidewalls 36 to hold and stabilize the spring 30. The spring 30 biases the crimp ends 24 together, which facilitates handling of the assembly 18 and crimp ring 50 when positioning on a fitting.

In operation, a hydraulic pump (not shown) builds up hydraulic pressure in the cylinder 12 to move the piston 14 and press the rollers 17 of the engagement member 16 against the arms 20*a* and 20*b*. The rollers 17 engage the surfaces 23 of the arms 20*a* and 20*b*, causing the arms 20*a* and 20*b* to rotate. Depending on the intake angle of the rollers 17 on the surfaces 23, a crimping force up to about 100 kN may be produced when measured at the crimp coupling centerline. Typically, the crimping time may be about 4 seconds, and the hydraulic output may be about 32 kN from the piston 14 of the crimping tool 10 to produce the input force to the crimping assembly 18.

When the arms 20*a* and 20*b* are actuated by displacement of the engagement member 16 associated with the hydraulic piston 14, the crimp ends 24 move together to actuate the crimp ring 50. The developed crimping force closes the portions 52*a* and 52*b* about the fitting. In some embodiments, the crimp ring 50 may pivot on the crimp ends 24 to enable an operator to crimp the fitting in locations of obstructed or limited accessibility.

The life and failure mode of crimping assemblies of the prior art, such as discussed above, may be unacceptable. The actuator arms undergo intense forces when crimping and can fail, which is undesirable. In the prior art, crimping assemblies have included straps attached to the arms to retain them on the assembly if they do fail.

In addition, crimping assemblies of the prior art may not always give an ideal or near ideal crimp on the fitting. In other words, the prior art crimping assemblies may not uniformly apply a crimping force to the fitting over the displacement of the piston. Furthermore, the force versus displacement profiles of the prior art crimping assemblies may not be consistent when used with fittings of various sizes, materials, or tolerances and especially when used with fittings having larger diameters up to 4-in.

Referring to FIGS. 2A–F, graphs of force profiles 60*a–f* are provided from test results using a prior art actuator assembly to actuate typical crimp rings to crimp fittings of various sizes. In FIGS. 2A–F, the input force (kN) as applied to the piston (14) is plotted against the piston displacement (in.) of the hydraulic piston engaging the actuator assembly. Each force profile 60*a–f* includes plots of three crimp operations.

Force profiles 60*a–f* illustrate test results using the prior art actuator assembly actuating typical, prior art crimp rings to crimp a 2.5-in. fitting on type K copper tubing, a 2.5-in. fitting on type M copper tubing, a 3-in. fitting on type K copper tubing, a 3-in. fitting on type M copper tubing, a 4-in. fitting on type K copper tubing, and a 4-in. fitting on type M copper tubing, respectively. In all cases, the material and geometry of the copper tubing are governed by the standard specification, ASTM B88, for seamless copper water tubing. For the force profiles 60*a–f*, the piston displacement of 0-inch corresponds to the point where the rollers 16 just make contact with the surfaces 23 of the arms 20*a* and 20*b* while the crimp ring 50 contacts an undeformed fitting. For clearance and for opening the actuator, it is understood that additional displacement of the piston of 2 to 3-mm typically exists before the rollers 16 make contact with the surfaces 23.

Each of the force profiles 60*a–f* includes an initial portion 62, a sustained portion 64, and a ramp portion 66. Some of the force profiles 60*a–f* require a significant amount of stroke to reach the sustained portion 64. For example, the force profile 60*a* in FIG. 2A requires roughly 0.6-in. of displacement before reaching 20 kN. The force profile 60*b* in FIG. 2B requires roughly 0.7-in. of displacement before reaching 20 kN. Some of the force profiles 60*a–f* have peaks where the force spikes generally higher than is ideally desirable when crimping fittings of various diameters. For example, the force profile 60*d* in FIG. 2D includes a peak 65 approaching nearly 30 kN at the displacement of approximately 0.9-in. Some of the force profiles 60*a–f* have sustained portions 64 with a higher force in general than is ideally desirable when crimping fittings of various diameters. For example, in the force profile 60*c* in FIG. 2C, the sustained portion 64 attains a level between 26 and 28 kN.

In the force profiles 60*a–f*, the total stroke (i.e., displacement of the hydraulic piston) extends for a longer displacement than is ideally desirable when crimping fittings of various diameters. The prior art actuator assembly and crimp rings require an excessive amount of stroke on the order of over 1.4-in. to crimp the larger fittings of 2.5, 3, and 4-in. The stroke length of over 1.4-in. is excessive when compared to the amount of stroke used by smaller sized assemblies, such as a 0.5-in. stroke for a ½-in. jaw assembly and a 1.2-in. stroke for a 2-in. jaw assembly.

The stroke length of over 1.4-in. is also excessive when compared to the amount of stroke available in a typical crimping tool. For example, the total available stroke of the typical crimping tool is approximately 40-mm or 1.57-in. with approximately 36-mm or 1.42-in. of that stroke being desirable for use in normal designs to accommodate manufacturing tolerances and to allow for clearance between the rollers and the actuator arms. Requiring over 1.4-in. of stroke length, the prior art crimping assembly lies close to the usable stroke limit.

Additionally, the prior art actuator assembly and crimp ring used to crimp the 3-in. fitting exhibited a tendency towards an excessively high peak 65 before reaching the final force of 32 kN. As shown in FIG. 2D, the peak is nearly 30 kN. If the premature peak triggers the pressure relief setting of 32 kN, this premature peaking could potentially cause the crimping tool to shut down before a completed crimp is formed with the actuator assembly and crimp ring. It is understood that the pressure relief setting of 32 kN can vary within a range, depending on the specific tool or type of tool being used and depending on a number of variables, such as voltage levels, tolerances, and temperature effects, among other variables.

The present invention is directed to overcoming or at least reducing one or more of the problems set forth above.

SUMMARY OF THE INVENTION

One aspect of the present invention discloses an improved assembly used with a displaceable member for actuating the assembly. The assembly includes an arm pivotably disposed in the assembly and having an edge. A profile is defined on the edge and is capable of being engaged by the displaceable member. The profile includes a first portion defining a radial contour of the edge, a second portion adjacent the first portion and defining a curved contour of the edge, and a third portion adjacent the second portion and defining a straight contour of the edge.

Another aspect of the present invention discloses an arm used with a displaceable member for actuating the arm. The arm includes a first end and an edge adjacent the first end. A profile is defined on the edge and is capable of being engaged by the displaceable member. At least a portion of the profile is defined by a non-linear, non-radial contour of the edge. In a further aspect, the profile may include a first portion being immediately adjacent the first end and defined by a radius, a second portion being adjacent the first portion and defined by the non-linear, non-radial contour, and a third portion being adjacent the second portion and defined by a linear function.

Another aspect of the present invention discloses an assembly used with a displaceable member for actuating the assembly. The assembly includes a plate, a pin, and an arm. The plate defines a first aperture and has a first hardness. The pin is disposed in the first aperture and has a second hardness. The second hardness is equal to or greater than the first hardness of the plate. The arm is positioned adjacent the plate and defines a first pivot aperture for the pin. The arm is rotatably disposed on the pin and is capable of being rotated by engagement with the displaceable member. The arm has a third hardness. The third hardness is greater than the first hardness. The arm can include a maximum section height at the first pivot aperture. The plate can have an edge defining a stress concentrator adjacent the first aperture. The first hardness can be approximately 30 to 35 Rc, and the third hardness can be approximately 56 to 59 Rc.

Yet another aspect of the present invention discloses an assembly used with a displaceable member for actuating the assembly. The assembly includes a first arm disposed in the assembly, a second arm disposed in the assembly, and a biasing member disposed in the assembly. The first arm has a first end and a first side adjacent the first end. The second arm has a second end and a second side adjacent the second end. The biasing member is disposed between the arms. The biasing member has a first portion adjacent the first side and has a second portion adjacent the second side. A first pin is disposed in a first hole defined in the first side. The first pin engages the first portion to hold the biasing member between the arms. A second pin on the second side can also be disposed in a second hole defined in the second side and can engage the second portion to hold the biasing member between the arms. The biasing member can be a leaf spring.

The foregoing summary is not intended to summarize each potential embodiment or every aspect of the invention disclosed herein.

BRIEF DESCRIPTION OF THE DRAWINGS

The foregoing summary, a preferred embodiment, and other aspects of the present invention will be best understood with reference to a detailed description of specific embodiments of the invention, which follows, when read in conjunction with the accompanying drawings, in which.

Figure 1:
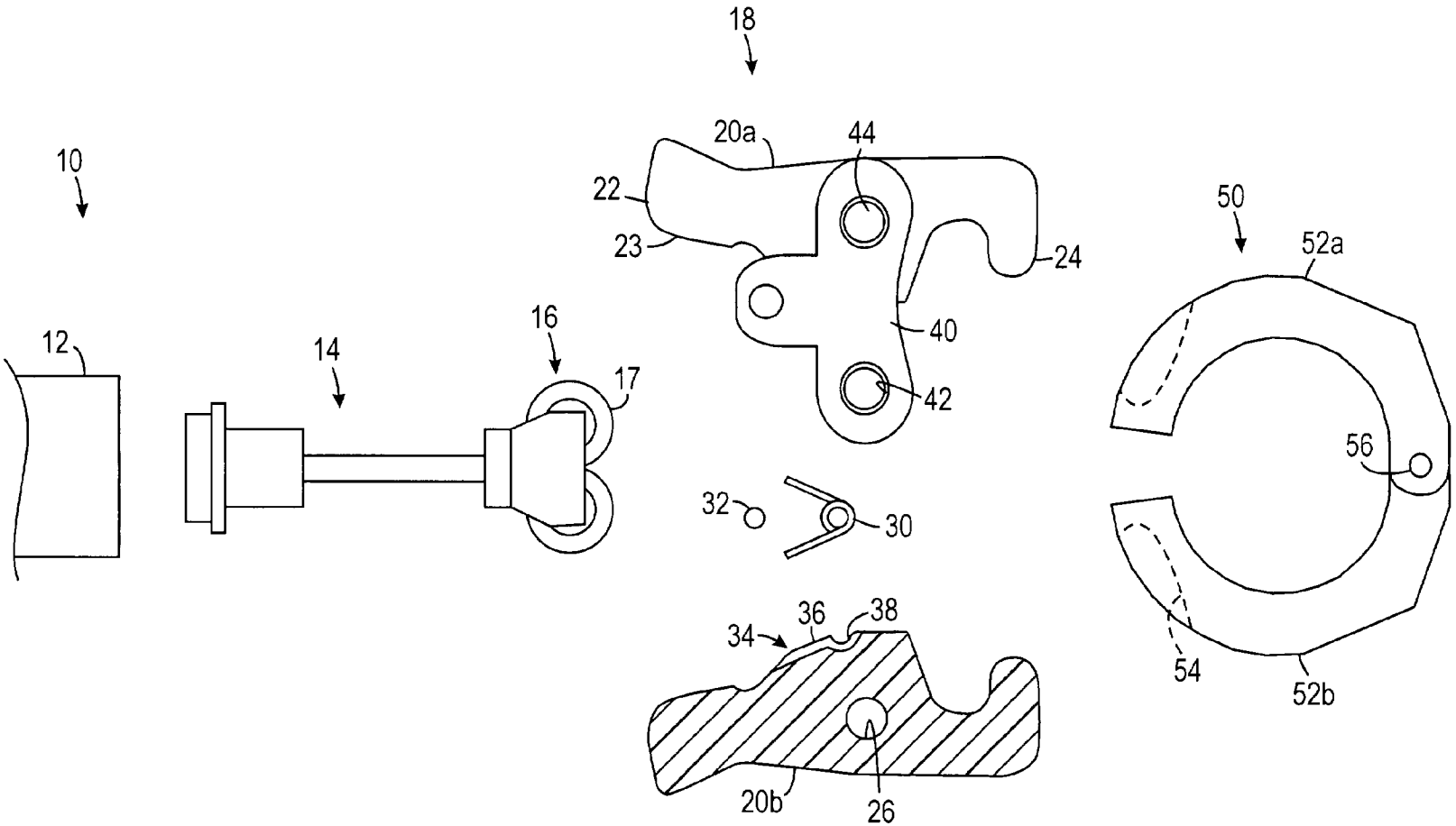
FIG. 1 (Prior Art)
FIG. 1 illustrates components of a crimping tool, actuator assembly, and crimp ring according to the prior art.
Figure 2A:
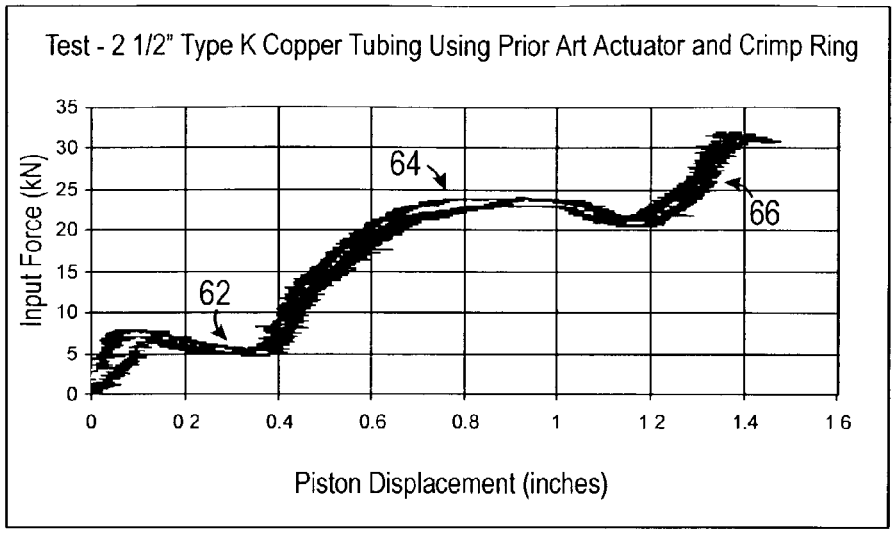
FIG. 2A (Prior Art)
FIGS. 2A–F illustrate test results graphing force versus displacement for an actuator assembly and crimp rings according to the prior art.
Figure 2B:
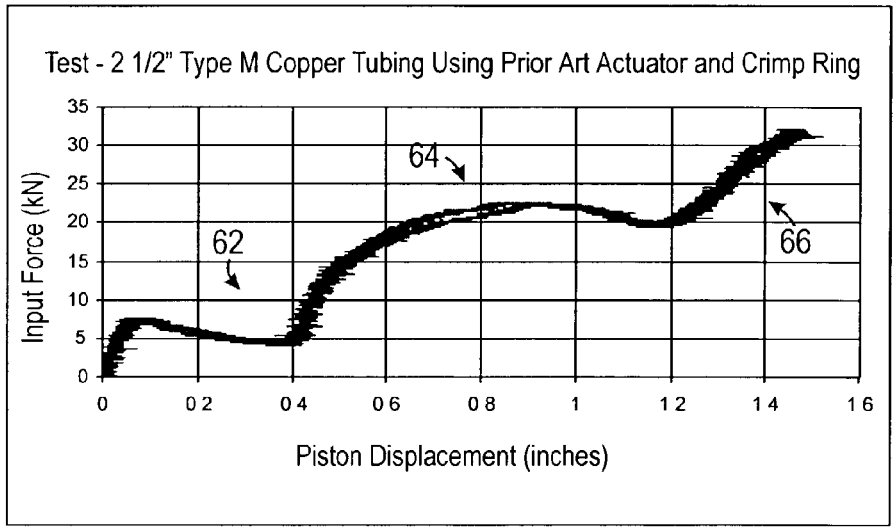
FIG. 2B (Prior Art)
Figure 2C:
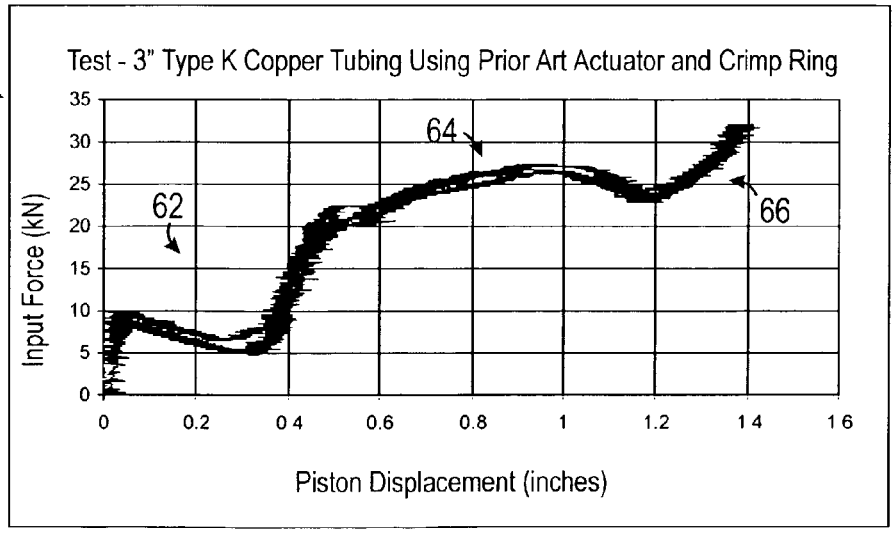
FIG. 2C (Prior Art)
Figure 2D:
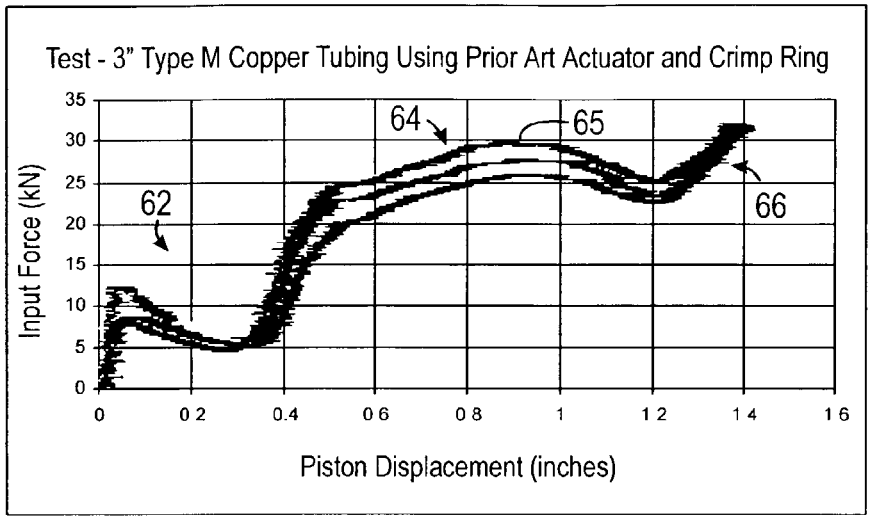
FIG. 2D (Prior Art)
Figure 2E:
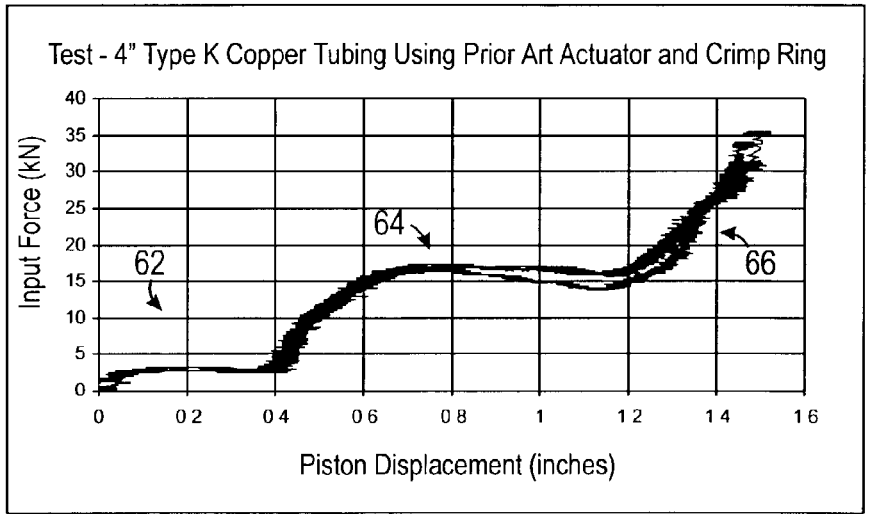
FIG. 2E (Prior Art)
Figure 2F:
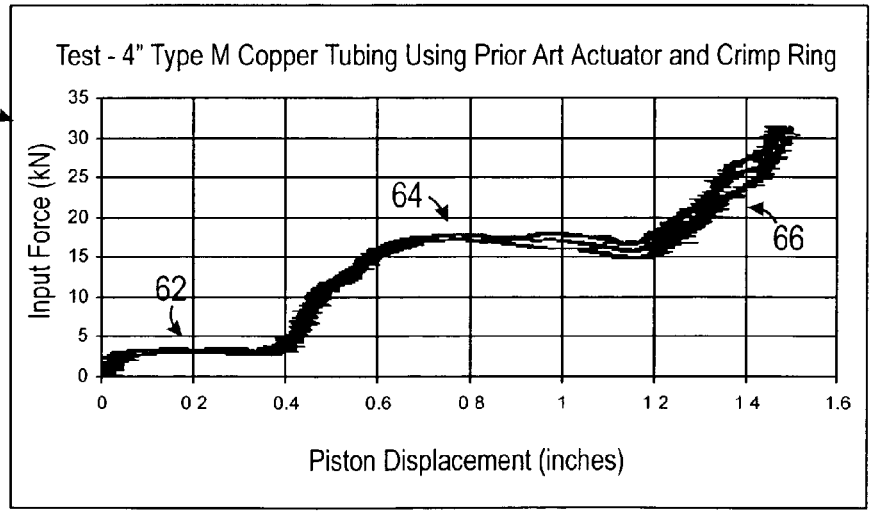
FIG. 2F (Prior Art)

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the scope of the invention as defined by the appended claims.

DETAILED DESCRIPTION OF THE INVENTION

Figure 3:
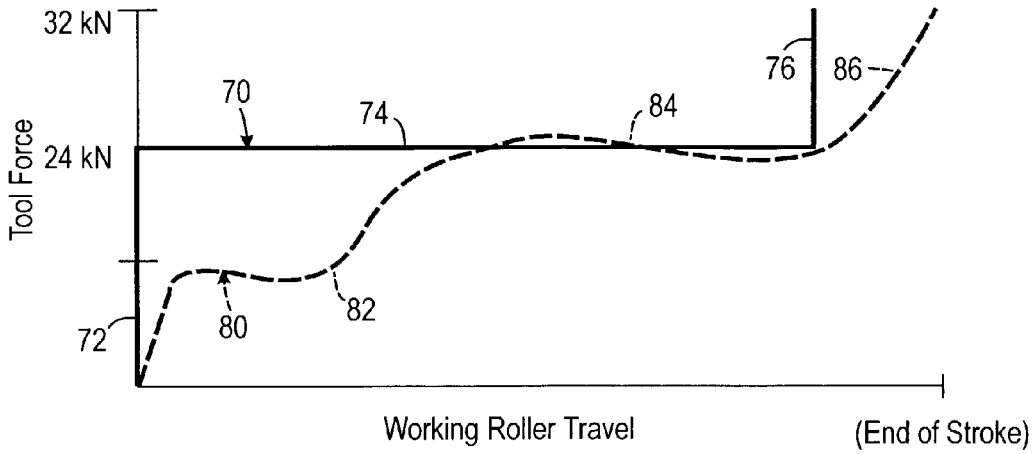
FIG. 3 illustrates a graph of an "ideal" force profile in conjunction with a near ideal force profile according to the present invention.

Referring to FIG. 3, a graph illustrates an "ideal" force profile in conjunction with a near ideal force profile in accordance with the present invention. The "ideal" force profile 70 includes a first step 72, a sustained portion 74, and an end step 76. The first step 72 reaches a crimping force with minimal displacement of the tool. The sustained portion 74 is about 75% of a shutoff force and occurs consistently over the displacement of the tool. The end step 76 rapidly reaches the shut off force of the crimping tool, typically 32 kN. In general, the "ideal" force profile 70 requires a small stroke or displacement to accomplish the crimping.

A near ideal force profile 80 of the present invention attempts to meet the "ideal" force profile 70. The near ideal force profile 80 has a longer stroke than the "ideal" force profile 80, because the near ideal force profile 80 requires more displacement to complete the same amount of work to crimp the fitting. It is understood, however, that differences between the "ideal" force profile 70 and the near ideal force profile 80 of the present invention exist due to a number of variables: including deflections of components; differences in tolerances; temperature effects; materials of the fittings, the actuator arms, and the crimp rings; and aspects determined by the plastic deformation of metals.

The near ideal force profile 80 in accordance with the present invention includes a first initial portion 82, a second sustained portion 84, and a third ramp portion 86. The initial portion 82 is governed by immediate changes in the deformation of the fitting and deflection of the tool. The initial portion 82 preferably requires little stroke length before reaching a substantially consistent force of the sustained portion 84. The ramp portion 86 preferably rapidly reaches the shut off force.

Figure 4:
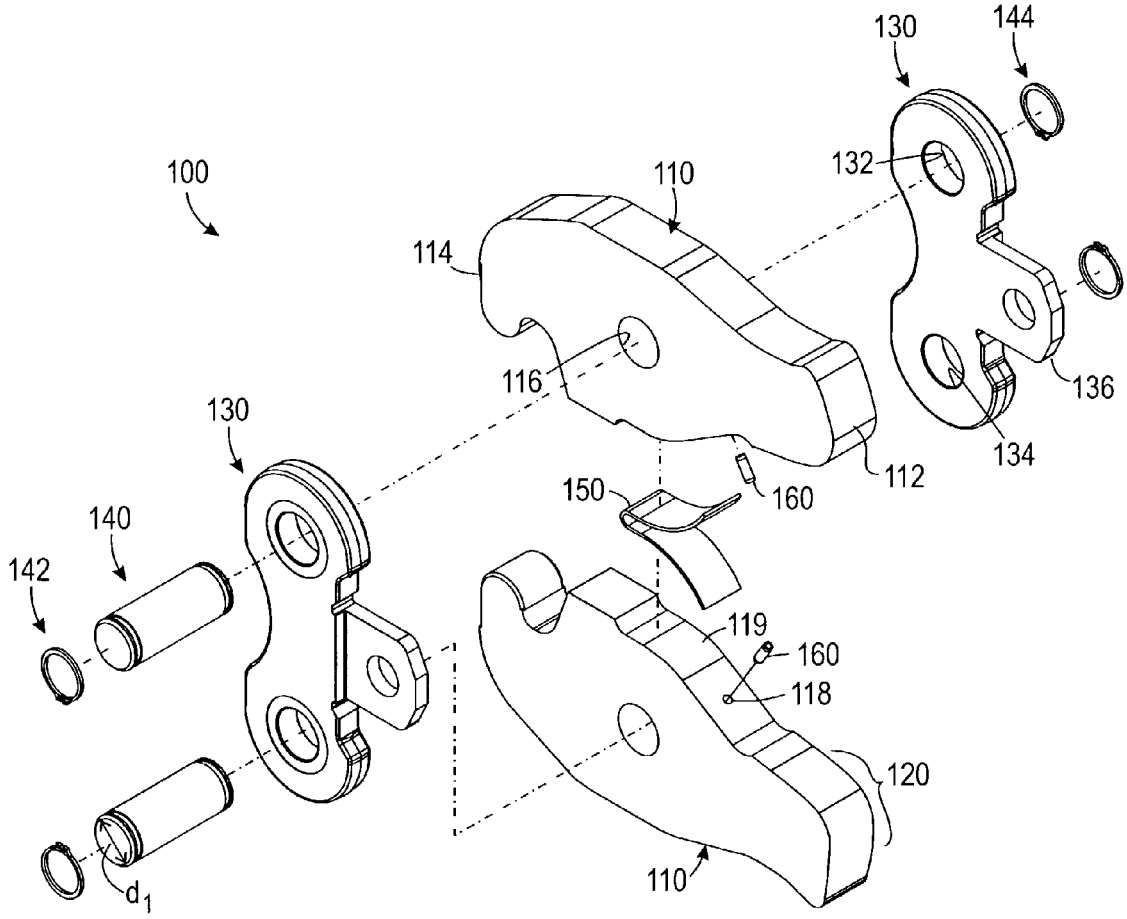
FIG. 4 illustrates an exploded view of an embodiment of an actuator assembly according to the present invention.

To accomplish a force profile similar to the near ideal force profile 80 in FIG. 3 and to improve the life of a crimping assembly, the present invention includes a number of improvements over the prior art. Referring to FIG. 4, an embodiment of an actuator assembly 100 according to the present invention is illustrated in an exploded view. In the present embodiment, the actuator assembly 100 actuates a crimp ring (not shown), such as discussed below with reference to FIG. 7. Although the present embodiment of the actuator assembly 100 is directed to actuating crimp rings, one of ordinary skill in the art will appreciate that the teachings of the present invention are applicable to other crimping assemblies, for example, assemblies including jaws for directly crimping fittings.

The actuator assembly 100 includes actuator arms 110, side plates 130, pivot pins 140, and a biasing member 150. The actuator arms 110 are substantially identical. Each of the arms 110 includes a first or cam end 112, a second or crimp end 114, and a side portion 119. Each arm 110 also defines a pivot bore 116 therethrough that is substantially perpendicular to the longitudinal dimension of the arm 100. The actuator arms 110 are disposed in the actuator assembly 100 with the side portions 119 adjacent one another. The biasing member or leaf spring 150 is disposed between the actuator arms 110 and adjacent the side portions 119.

In conjunction with the spring 150, the actuator arms 110 of the present invention define holes 118 in the side portions 119. Holding pins 160 are disposed in the holes 118 to retain the spring 150 between the arms 110. Retaining the spring 150 with a step, shoulder, or pocket formed into the side portions 119 is undesirable. A step, shoulder, or pocket in the arm 110, as done in the prior art, creates a large stress riser in the arm 110, causing early breakage.

The side plates 130 are substantially identical and are disposed parallel to one another on either side of the arms 110. Each of the side plates 130 defines pivot apertures 132 and 134 and includes a portion 136 for connecting the assembly 100 to a crimp tool (not shown). Relevant details of the side plate 130 are discussed below with reference to FIG. 9A–B. The pivot pins 140 are positioned through the apertures 132 and 134 in the side plates 130 and through the bores 116 in the arms 110. Retaining rings 142 and 144 are disposed on the ends of the pivot pins 140 to hold the assembly 100 together.

As best described above, rollers of a displaceable engagement member (not shown) within the crimp tool contacts the cam ends 112 of the actuator arms 110, causing the actuator arms 110 to pivot respectively about the pivot pins 140 disposed in their pivot bores 116. A crimping force is developed and applied to a crimp ring (not shown) coupled to the crimp ends 114. In contrast to the actuator assemblies of the prior art discussed above, the actuator arms 110 of the present invention include cam profiles 120, which control the application of the input force applied by the crimping tool on the arm 110 in relation to the displacement of the engagement member within the crimp tool. The cam profiles 120 produce a substantially more uniform or stable force profile on a number of different sized fittings and crimp rings than evidenced in the prior art. Therefore, the cam profiles 120 of the present invention are capable of substantially and uniformly applying the output force over the displacement of the displaceable engagement member.

The cam profiles 120 of the actuator arms 110 determine the input force on the arms 110 substantially required at a given displacement of the piston. In turn, the cam profiles 120 determine the resulting output force produced with the crimp ring. To accomplish a force profile similar to the "ideal" and near ideal force profiles 70 and 80 in FIG. 3, the cam profiles 120 of the actuator assembly 100 are designed to provide a very specific input force versus displacement curve. The desired constraints on the application of the input force by the cam profiles 120 are as follows.

First, the cam profiles 120 preferably minimize the displacement or stroke required to crimp various sized fittings, for example 2.5, 3, and 4-in. fittings. Second, the cam profiles 120 preferably remove or limit any peaks in the force profile from occurring before attaining the tool shut off force, for example 32-kN. Third, the cam profiles 120 preferably lower the required or sustained input force from the start of crimping until the very end of the stroke as much as possible. For example, the cam profiles 120 of the present invention attempt to lower the required force from the start of crimping until the very end of the stroke as much as possible. The sustained force preferably occurs for approximately 80% of the stroke, and the force preferably ramps rapidly to the shut off force for the remaining 20% of the stroke. Fourth, the cam profiles 120 preferably complete the above three constraints for all three sizes of fitting without adversely affecting any one size. Lastly, the cam profiles 120 preferably meet the dimensional constraints of the crimping tool, such as the diameter of the rollers, stroke of the piston, and position of the pivot pins.

To develop a model of a cam profile to meet these constraints, testing was performed using an existing actuator assembly to understand the crimp force required at the crimp ring. An algorithm for the cam profile model was developed to perform calculations. The algorithm accounted for system deflections, such as deflections of the side plates and arms of the existing assembly, in relation to the positioning of the crimp ends and the changing of the angles on the cam ends of the arms. A spreadsheet was used for the calculations.

First, a generalized crimp ring force profile was analyzed with respect to the existing actuator assembly, such as described above with reference to FIGS. 1 and 2. To test the algorithm, dimensional information from the existing actuator of the prior art was input into the algorithm, along with the crimp ring force data. An actuator input force verses displacement curve was generated, which was compared to actual, recorded test data using the existing actuator assembly. From the comparison, it was determined that there was a difference due to friction and a slight difference in the model, among other differences. The cam profile model was then slightly modified using experimentally derived correction factors to obtain agreement with the actual data.

Then, this cam profile model and data were used to design a cam profile for actuator arms of an actuator assembly capable of controlling the input force versus displacement of the engagement member. An iterative process was performed to generate points every 0.040" for the cam profile on the cam end of the arms; however, the points could have been generated at any small increment. The points were based on a desired tool input force and other inputs from the model. From this data, the information was translated into a cam profile 120 of the present invention as described below with reference to FIGS. 5A–B.

Figure 5A:
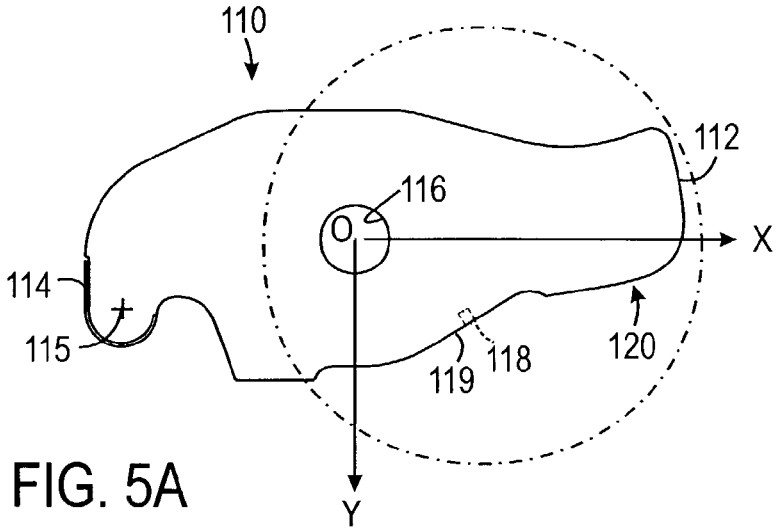
FIGS. 5A–B illustrate various view of an arm of the actuator assembly of FIG. 4.
Figure 5B:
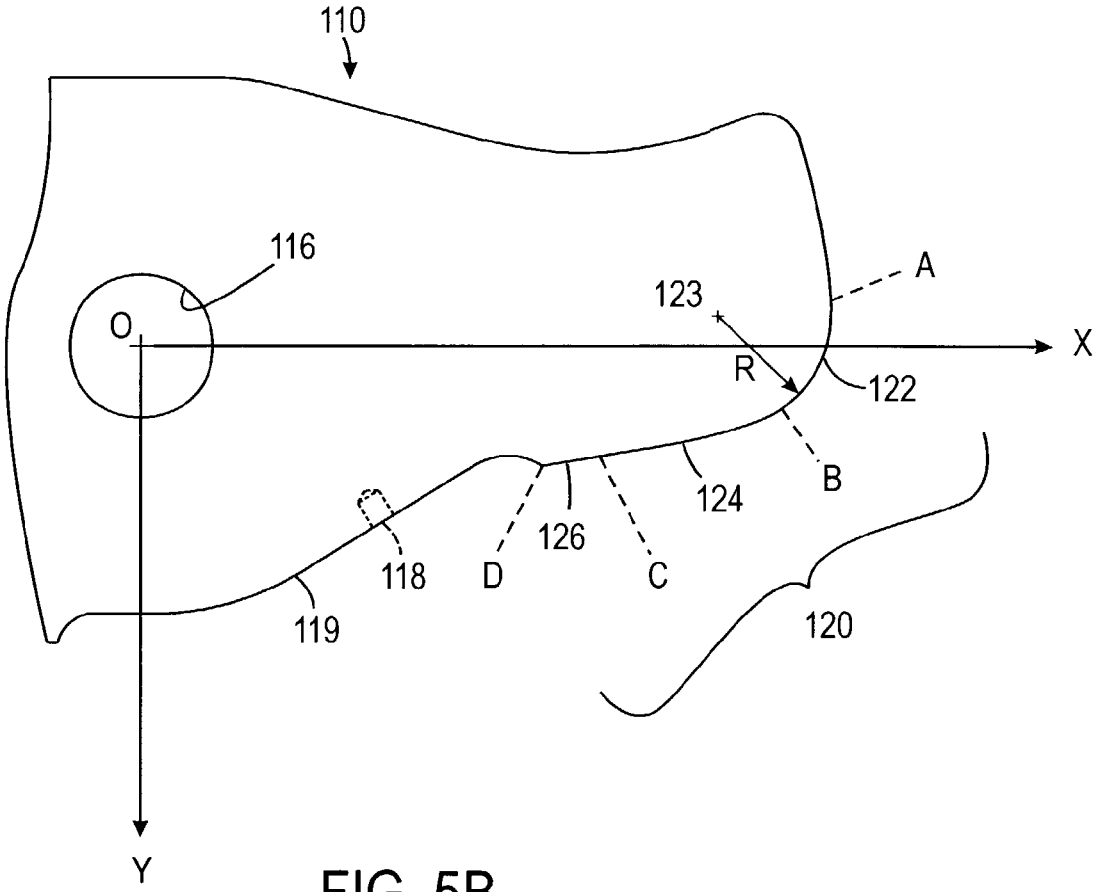

Referring to FIGS. 5A–B, an embodiment of an actuator arm 110 in accordance with the present invention is illustrated in a side view and an enlarged, detailed view, respectively. A reference coordinate system (X, Y) is provided in FIGS. 5A–B. The coordinate system includes orthogonal axes X and Y for describing the exemplary dimensions of the present embodiment of the actuator arm 110 and cam profile 120. The axes X and Y have an origin O at the center of the pivot bore 116 about which the arm 110 rotates.

In general, the actuator arm 110 of the present embodiment has a length of approximately 166.76-mm (6.565-in.) along the longitudinal axis X, a height of approximately 75.95-mm (2.990-in.) along the lateral axis Y, and a thickness of approximately 20-mm (0.787-in.) along a mutually orthogonal axis. The crimp end 114 includes a tip having a radius of approximately 10-mm situated at a reference point 115 of approximately (−65, 21)-mm.

As best illustrated in the detailed view of FIG. 5B, the cam profile 120 includes a first, radial portion 122; a second, curved portion 124; and a third, ramped portion 126. For illustrative purposes, geometric points A, B, C, and D are provided in FIGS. 5B to show separation points between the first, second, and third portions 122, 124 and 126.

The first, radial portion 122 is defined by a radius R of approximately 15-mm (0.591-in.) at a point 123 having the coordinate (76.79, −4.02)-mm or (3.023, −0.158)-in. The first, radial portion 122 is immediately adjacent the cam end 112, starting at a point A on the cam end 112 and ending at point B of approximately (7.8, 86.03)-mm or (0.307, 3.387)-in. The first portion 122 is the portion of the cam profile 120 first contacting the rollers on the engagement member, as discussed above. In terms of controlling the input force versus displacement of the crimping tool, the first portion 122 corresponds roughly to the initial portion of the input force versus displacement profile, such as the initial portion 82 discussed above in FIG. 3. It is to be understood, however, that some overlap can exist between the portions of the cam profile 120 corresponding roughly to portions of the force profile produced with the cam profile 120.

The second, curved portion 124 of the cam profile 120 is substantially contiguous with the first portion 122 and lies between the geometric points B and C. The point C is situated at the reference coordinate of approximately (14.42, 62.68)-mm or (2.468,0.568)-in. The second, curved portion 124 of the cam profile 120 is defined by a curved contour. Preferably, for the present embodiment, the second portion 124 is defined by a 10th order polynomial equation, as described below. In terms of controlling the input force of the crimping tool, the second portion 124 corresponds roughly to the sustained portion of the input force versus displacement profile, such as the sustained portion 84 discussed above in FIG. 3.

The third, ramp portion 126 is substantially contiguous with the second portion and lies between points C and D on the cam profile 120. The point D is situated at the reference coordinate of approximately (53.55, 15.96)-mm or (2.108, 0.629)-in. The third, ramp portion 126 is defined by a linear equation having a particular slope and location with respect to the center of rotation O. In terms of controlling the input force of the crimping tool, the third portion 126 corresponds roughly to the ramp portion of the input force versus displacement profile, such as the ramp portion 86 discussed above in FIG. 3.

The exemplary dimensions and values disclosed herein apply to the present embodiment of the actuator arm 100. It is understood that the magnitude of these values may differ for an arm having an overall smaller or larger dimension. The magnitude of these values may also differ for arms used on different fittings or used with different forces. Depending on such differences, one of ordinary skill in the art will appreciate that the relationship of the values may change or may remain substantially the same.

The second, curved portion 124 of the cam profile 120 is preferably defined by a 10th order polynomial, as follows:

$$y=Ax^{10}+Bx^{9}+Cx^{8}+Dx^{7}+Ex^{6}+Fx^{5}+Gx^{4}+Hx^{3}+Ix^{2}+Jx^{1}\mathbf{30}\ K$$

where, the values of the constants A–K when the X-coordinate is given in terms of inches are as follows:

TABLE

Values of constants for 10th Order Polynomial

| Variable | Value |
|---|---|
| A | −48.9913974944589 |
| B | 1463.61453291994 |
| C | −19630.1624858022 |
| D | 155664.66890622 |
| E | −808294.682548789 |
| F | 2871872.99972913 |
| G | −7071260.01718111 |
| H | 11914996.6049983 |

TABLE-continued

| Values of constants for 10th Order Polynomial | |
|---|---|
| Variable | Value |
| I | −13149361.9925974 |
| J | 8582947.63458813 |
| K | −2516314.38595924 |

Using the $10^{th}$ order polynomial equation with these constants, the points for the second, curved portion 124 of the cam profile 120 can be obtained. For example, a point having a distance X=2.7349-in. from the origin O at the pivot point yields a point of Y=−0.5238-in., which lies on the second portion 124 of the cam profile 120 in accordance with the present invention. For example, a point having a distance X=3.3606-in. yields a point of Y=−0.3278-in. About 850 points are preferably used to generate a substantially continuous curved portion 124 for the cam profile 120 of the present invention. A milling machine can be used with these numerous points to create a substantially continuous contoured portion on an actuator arm.

As disclosed above, the cam profile 120 according to the present embodiment includes the radial portion 122, the curved portion 124, and the ramp portion 126 to advantageously control the input force versus displacement for a crimp ring actuator assembly. The curved portion 124 of the present embodiment is preferably a curved contour of the edge of the arm defined by a $10^{th}$ order polynomial function. This embodiment of the cam profile 120 is based on a preferred embodiment of an actuator arm used for actuating a crimp ring to crimp ProPress XL® fittings of approximately 2.5 to 4-in. It is appreciated that the values disclosed above are exemplary and can be varied depending on the type of fitting, the desired accuracy for controlling the input force, etc. For example and without limitation, one of ordinary skill in the art will appreciate that the function and values disclosed above can be changed with the teachings of the present invention to achieve fewer or more points for the curved portion 124. In addition, one of ordinary skill in the art will appreciate that the function and values disclosed above can be changed with the teachings of the present invention for crimping fittings with characteristics different from ProPress XL® fittings of approximately 2.5 to 4-in.

Furthermore, one of ordinary skill in the art will appreciate that the second portion 124 need not be defined by a $10^{th}$ order polynomial, but that other order polynomial functions can be used. In addition, it will also be appreciated that a cam profile of the present invention can include one or more contours or portions defined by non-linear and non-radial functions other than polynomial functions. For the purposes of the present disclosure, a non-linear function refers to a mathematical function that is not linear, and a non-radial function refers to a mathematical function that is not defined by a constant radius about a central point. Consequently, a cam profile according to the present invention can be defined by portions or combinations of a number of mathematical functions, including but not limited to linear functions, radial functions, logarithmic functions, exponential functions, trigonometric functions, or high order polynomial functions. Determining requisite values, details, and specifics of such a cam profile will depend on a number of variables and constraints noted herein. With the benefit of the present disclosure, one of ordinary skill in the art would find it a routine undertaking to determine such requisite values, details, and specifics for a given implementation.

One of ordinary skill in the art will further appreciate that defining three, distinct portions of the cam profile 120 may not be strictly necessary. Instead, it will be appreciated that a single mathematical function can be used to define substantially the entire contour of a cam profile according to the present invention. Such a cam profile can be substantially equivalent to the cam profile 120 disclosed above having the portions 122, 124, and 126 and can be defined by a high order polynomial or other function. The requisite values, details, and specifics of such a cam profile will depend on a number of variables and constraints noted herein. With the benefit of the present disclosure, one of ordinary skill in the art would find it a routine undertaking to determine such requisite values, details, and specifics for a given implementation.

The cam profile 120 of the present embodiment having the radial portion 122, the curved portion 124, and the ramp portion 126 advantageously controls the input force versus displacement when used with various fittings, as compared to the input force versus displacement profiles for prior art assemblies shown in FIGS. 2A–F. The cam profile 120 on arms of an actuator assembly according to the present invention produces the force versus displacement profiles discussed below with reference to FIGS. 6A–C.

Figure 6A:
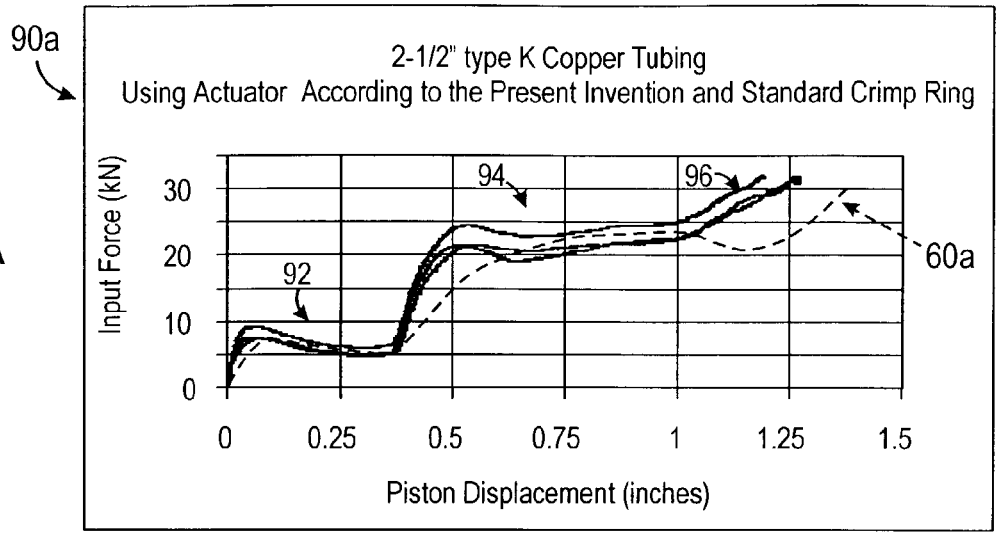
FIGS. 6A–C illustrate test results graphing force versus displacement for an actuator assembly according to the present invention.
Figure 6B:
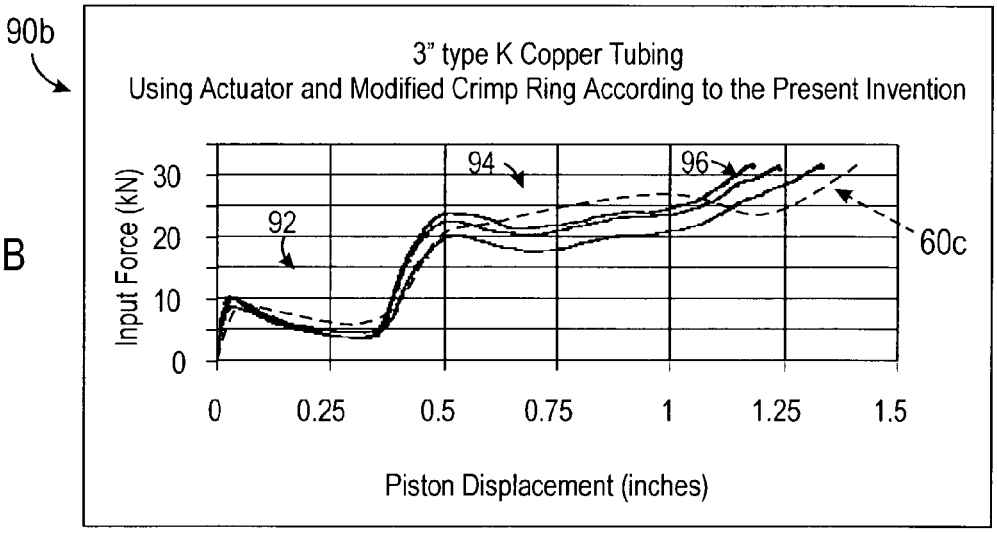
Figure 6C:
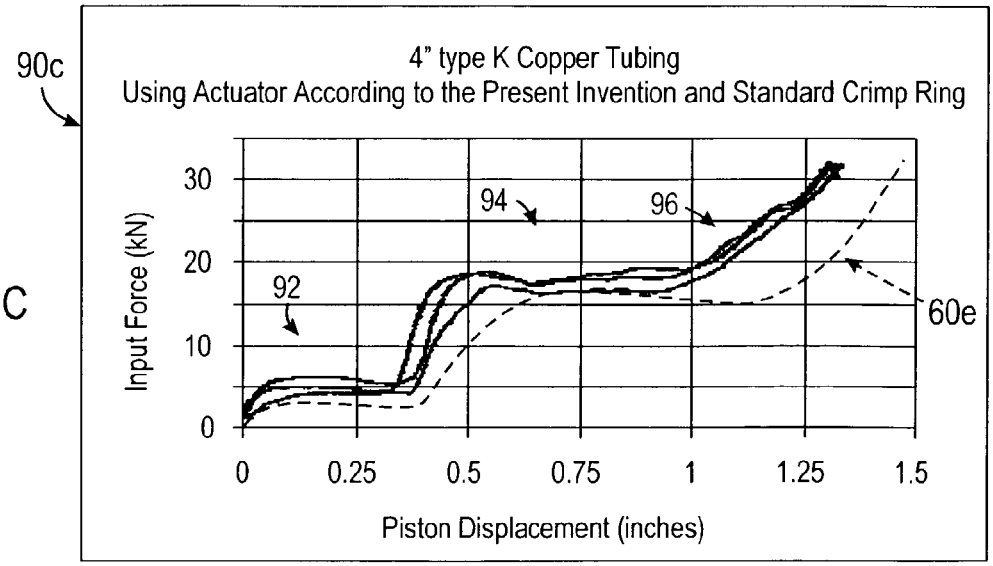

Referring to FIGS. 6A–C, test results are illustrated using the actuator assembly 100 having cam profiles 120 in accordance with the present invention to actuate crimp rings to crimp larger fittings. The test results are graphed as input force versus displacement curves. As evidenced in the graphs, the cam profile 120 of the present invention advantageously reduces the overall displacement necessary for crimping fittings of 2.5, 3, and 4-in. For example, the amount of stroke required for assemblies according to the present invention is approximately 1.3-in., which is less than the usable stroke of 1.42-in. and less than the prior art stroke of over 1.4-in. Furthermore, the cam profile 120 of the present invention makes the force substantially uniform during the crimp, advantageously minimizing the number of peaks occurring in the force curve before attaining the 32 kN tool shut off force. Moreover, the cam profile 120 of the present invention advantageously ramps rapidly to shut off force in approximately the last 20% of the stroke.

For comparative purposes, the corresponding force profiles 60*a*, 60*c*, and 60*e* achieved with the prior art are shown in dotted line in FIGS. 6A–C, respectively. In FIG. 6A, crimps were made on a 2.5-in. fitting on type K copper tubing with the same crimp ring as used in FIG. 2A of the prior art, but using an actuator assembly with cam profiles according to the present invention. Recalling in FIG. 2A, the force profile 60*a* of the prior art requires 0.6-in. of displacement before reaching 20 kN and requires a total stroke length of almost 1.4-in. In contrast, the force profile 90*a* of the present invention reaches 20 kN in approximately 0.4 to 0.5-in. and has a total stroke length not more than 1.25-in. Furthermore, the force profile 90*a* of the present invention has a substantially more consistent sustained portion 94.

In FIG. 6C, crimps were made on a 4-in. fitting on type K copper tubing with a typical crimp ring and with an actuator assembly according to the present invention. Recalling in FIG. 2E, the force profile 60*e* of the prior art requires 0.6-in. of displacement before reaching 15 kN and requires a total stroke length of over 1.4-in. In contrast, the force profile 90*c* of the present invention reaches 15 kN in approximately 0.35 to 0.5-in. and has a total stroke length not more than 1.3-in. Furthermore, the force profile 90*c* has a substantially more consistent sustained portion 94.

Figure 7:
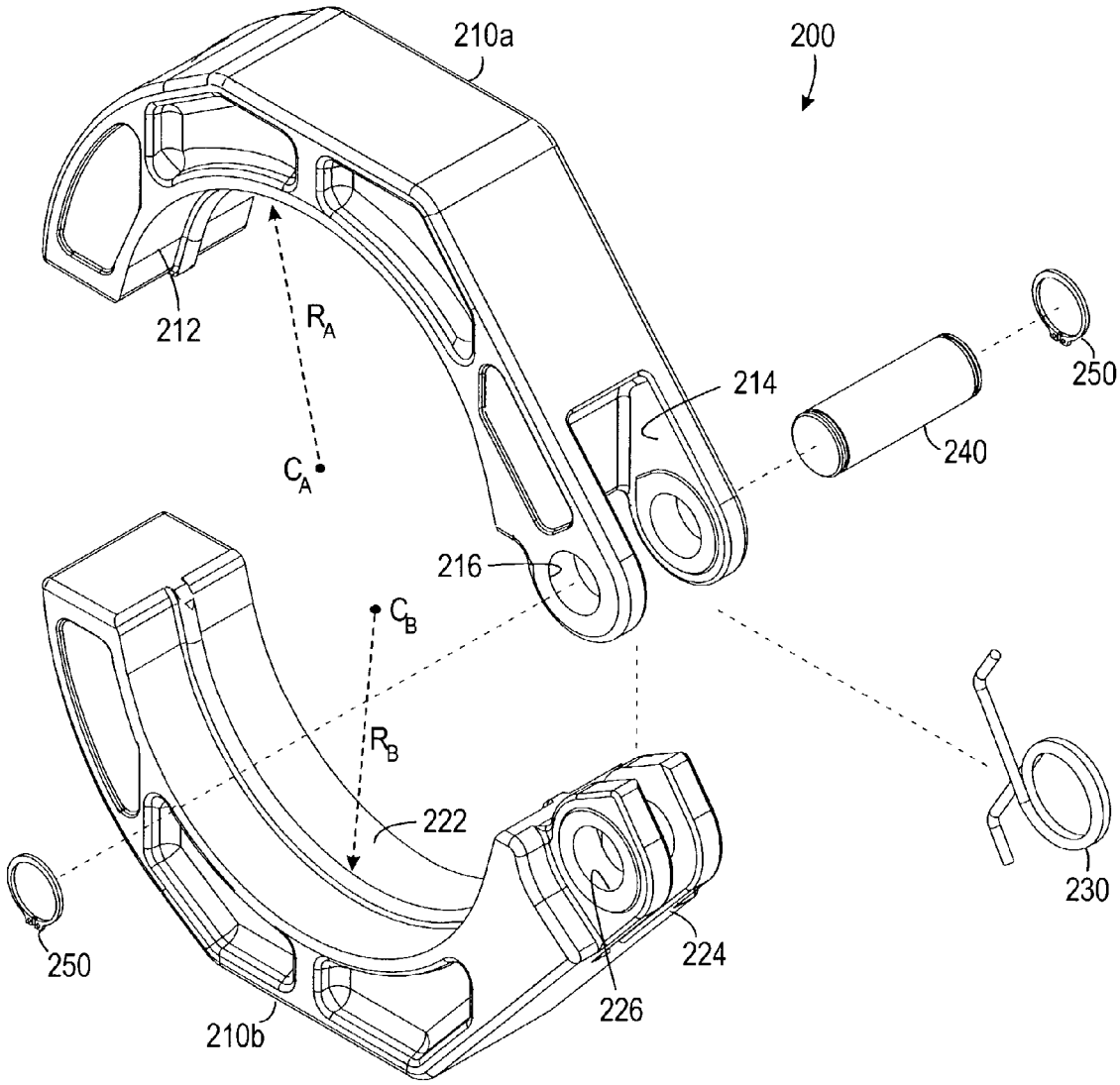
FIG. 7 illustrates an exploded view of an embodiment of a crimp ring according to the present invention.

In FIG. 6B, crimps were made on a 3-in. fitting on type K copper tubing with a modified crimp ring and an actuator assembly according to the present invention. An exploded view of crimp ring 200 in accordance with the present invention is illustrated in FIG. 7. The crimp ring 200 includes a first portion 210*a*, a second portion 210*b*, a biasing member or torsion spring 230, and a pivot pin 240. The crimp ring portions 210*a* and 210*b* are preferably carburized, hardened, and drawn to a surface hardness in the high 50's, Rockwell "C," although other hardening techniques, such as through hardening or localized hardening, known in the art could be used. The first portion 210*a* includes a crimping surface 212 and a bifurcate end 214 with pivot bores 216. The second portion 210*b* also includes a crimping surface 222 and a bifurcate end 224 with pivot bores 226. The bifurcate end 224 positions within the bifurcate end 214 of the first portion 210*a*, and the pivot bores 226 are aligned with the pivot bores 216. The biasing member or torsion spring 230 is positioned in a pocket defined by the bifurcate end 224. The pivot pin 240 is inserted through the respective bores 216 and 226 and through the spring 230. External retaining rings 250 are attached to the ends of the pivot pin 240.

In one embodiment of the present invention, the first and second surfaces 212 and 222 each define a radius that is greater than found on crimp rings of the prior art. In particular, on the crimp ring for crimping 3-in. fittings in FIG. 6B, the present invention provides a first radius $R_a$ for the first surface 212 and a second radius $R_b$ for the second surface 214. Each radius $R_a$ and $R_b$ is defined from a center point $C_a$ and $C_b$, respectively. When the crimp ring 200 is closed, the center points $C_a$ and $C_b$ are positioned adjacent, but not necessarily coincidental. The radii $R_a$ and $R_b$ are capable of forming a diameter of approximately 3.60-in. (91.5-mm). Prior art crimp rings have portions with radii for forming diameters of approximately 3.58-in. (91.0-mm) for crimping a 3-in. (76-mm) fitting. Thus, the dimension of the crimp ring 200 is increased approximately 0.5-% to meet the force versus displacement constraints for the 3-in. fittings.

In FIG. 6B, an actuator assembly according to the present invention is used with a modified crimp ring 200 having an increased dimensions for the crimping surfaces 212 and 214, as described above, to crimp a 3-in fitting on type K copper tubing. Recalling in FIG. 2C, the force profile 60*c* of the prior art requires a total stroke length of over 1.4-in., and the sustained portion 64 attains a level between 26 and 28 kN, which is undesirably high. In contrast, the force profile 90*b* of the present invention has a reduced force level between 17 and 25 kN in the sustained portion 94. Furthermore, the force profile 90*b* has a total stroke length not more than 1.3-in. The testing of the crimp ring 200 with increased diameter D and the actuator assembly according to the present invention confirms that the required crimping force decreases with its use as compared to the prior art. Consequently, the increased dimensions for the crimping surfaces 212 and 214 on the crimp ring 200 advantageously reduce the required force for crimping the 3-inch fitting.

It should be noted that the actuator assembly according to the present invention used with the modified crimp ring 200 having the increased dimensions for the crimping surfaces 212 and 214 is one solution for reducing the required force for crimping the 3-inch fitting. One of ordinary skill in the art will appreciate that the teachings of the present invention could be used to develop a specific cam profile having characteristics advantageous to reduce the required force for crimping the 3-inch fitting. Such a specific cam profile could be designed for use with a typical, unmodified crimp ring of the prior art.

In comparing the test results using the actuator assembly with cam profiles 120 of the present invention in FIG. 6A–C with the test results using the prior art assembly illustrated in FIGS. 2A–F, it is seen that the cam profile 120 according to the present invention advantageously controls the input force versus displacement and meets the constraints as stated above. Although the cam profile 120 meets the above stated constraints to give the output forces in FIG. 6A–C, it should be noted that the teachings of present invention could be implemented to achieve additional methods of controlling the input force versus displacement, as follows.

For example, a cam profile according to the teachings of the present invention may be used to maintain a nearly constant tool force versus displacement for all sizes of fittings so the tool always encounters the same loading. In another example, a cam profile according to the teachings of the present invention may be used to implement a rapid, initial close onto a fitting in order to grip the fitting early in the crimp operation and maintain alignment with the fitting. In yet another example, a cam profile according to the teachings of the present invention may be used to create a progressive crimp for a special fitting, where the assembly first crimps a pilot crimp for fitting alignment and then follows through with a completing crimp.

In a further example, a cam profile according to the teachings of the present invention may be used to crimp in shorter or longer strokes than explicitly set forth herein. For instance, assemblies having smaller arms or jaws used to crimp smaller fittings do not require most of the stroke of a crimping tool. The smaller assembly may only require 25-mm of the total 40-mm stroke, for example. Accordingly, a cam profile can be developed using the teachings of the present invention to provide a force versus displacement profile having the beneficial characteristics over the prior art and achieving these characteristics in a shorter stroke. Using the teachings of the present invention, one of ordinary skill in the art could develop such a cam profile for a shorter or longer stroke with the appreciation that differences in angular relations, deflections, forces, and geometry must be taken into account when developing such a cam profile.

In another example, a cam profile according to the teachings of the present invention may be applied to other devices, such as crimp jaws of a smaller size or cutting tools. The teachings of the present invention may also be suitable for controlling the input force versus displacement for a battery powered crimping tool. Typically, a battery powered crimping tool includes a battery power supply for a motor operating a hydraulic pump. The motor and pump typical have ranges where they operate most efficiently. Using the teachings of the present invention, a cam profile can be developed to provide a force versus displacement profile that is beneficial to the efficient operating ranges of the motor and pump. Depending on the motor and pump, for example, it may be found that they operate more efficiently with a particular level of force in the sustained portion of the force profile. A cam profile can be developed with the teachings of the present invention to control the input force over the displacement to meet this efficient level. With the motor and pump operating efficiently, the tool may be used for more crimping operations before the power supply requires recharging.

Returning to FIG. 4, the actuator assembly 100 of the present invention also includes other improvements over the prior art, which enhance the life of the components and produce a desired failure mode for the assembly 100. In tests of the prior art assemblies, it has been found that the failure mode of the assemblies or jaw sets is due to fatigue in the side plates, pivot pins, and jaw or arms. A desirable failure mode, however, is a passive failure in the side plates 130 only. Accordingly, the actuator assembly 100 of the present invention includes side plates 130 configured to resist failure up to a level of fatigue so that the side plates can have a life of about 10K cycles. The other components, such as the arms 110 and pins 140, are configured to resist failure to levels of fatigue so that these other components can have lives of about 50K+ cycles.

Achieving the desired passive failure mode in the side plates 130 depends on a passive failure system between the components in the actuator assembly 100. A number of variables, including the geometry, material, metallurgical processing methods, and heat treatment of the components as well as other variables, such as the intended force to be applied to the actuator assembly 100 are involved in the passive failure system. In the discussion that follows, a preferred passive failure system for components of the actuator assembly 100 according to the present invention is provided to achieve passive failure in the side plates 130 above other modes of failure. It is understood that the values given are exemplary for the particular dimensions and other variables of the actuator assembly 100 of the present embodiment.

Firstly, the pivot pins 140 of the actuator assembly 100 constitute part of the passive failure system. The side plates 130 are configured to resist failure up to a first level so that the side plates can have a fatigue life of about 10K cycles. The pivot pins 140 according to the present invention have diameters $d_1$ that are greater than found in the prior art. The increased diameter $d_1$ prevents breakage, increasing the life of the pivot pins 140. Preferably, the pivot pins 140 have a diameter $d_1$ of approximately 19.08-mm for the present embodiment of the actuator assembly 100. The hardness of the pivot pins 140 is preferably greater than that of the side plates 130 to ensure a passive mode of failure for the assembly as discussed herein. For example, the pivot pins 140 are composed of steel and have a hardness that is approximately equal to or greater than the hardness of the side plates 130. Namely, the pins 140 preferably have a hardness approximately equal to or greater than the hardness of the side plates 130 of 30 to 35 Rc. The pins 140 are carburized to have a surface hardness of approximately 58 to 61 Rc and a core hardness in the low 40's Rc.

Secondly, the actuator arms 110 constitute another part of the passive failure system and are configured to resist failure up to a second level so that the arms 110 can have a fatigue life of about 50K+ cycles. The material and hardness of the arms 110 are part of this resistance to failure. Preferably, the actuator arms 110 are composed of S-7 tool steel and are preferably vacuum hardened and double drawn. The preheat in the heat treatment is preferably 1550° F. The material is preferably austentized at a temperature of approximately 1800° F. Drawing of the material for the actuator arms is 110 twice done at a temperature of approximately 400° F. The arms 110 preferably have a hardness of approximately 56 to 59 Rc.

Figure 8:
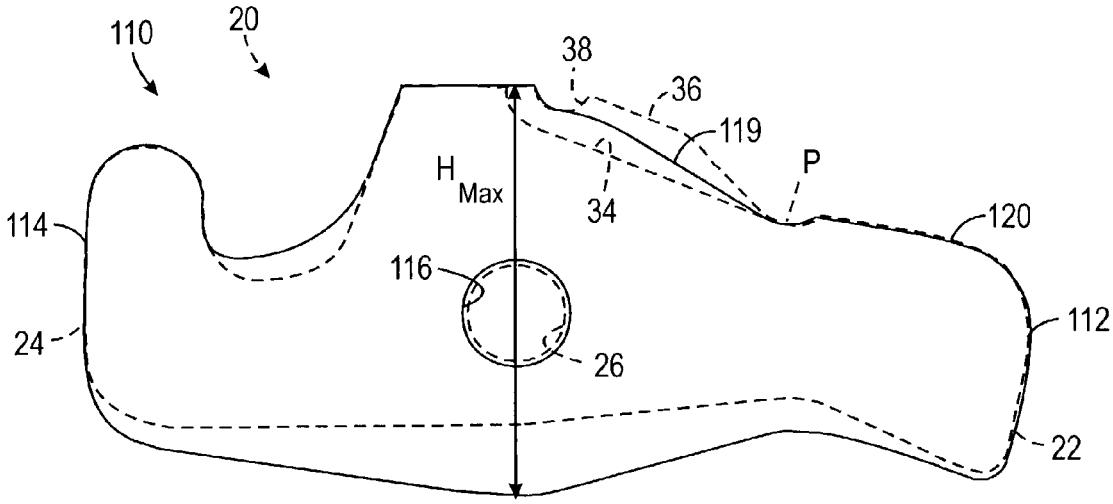
FIG. 8 illustrates details of an actuator arm in accordance with the present invention as compared to a prior art actuator arm.

Thirdly, the section height of the actuator arms 110 constitutes another part of the passive failure system and part of the arms' resistance to failure to the second level of fatigue. Referring to FIG. 8, a solid outline of an actuator arm 110 of the present invention is juxtaposed with a dotted outline of a prior art actuator arm 20. The actuator arm 110 of the present invention includes an increased section height H over the prior art arm 20. The section height H defines a lateral dimension of the arm 110 as opposed to the axial dimension of the arm 110 from the cam end 112 to the crimp end 114. The section height H is increased throughout the arm 110 in highly stressed regions and is greatest at the mid-section of the arm 110 where the pivot bore 116 is defined. For example, the actuator arm 110 has a maximum section height $H_{max}$ of approximately 2.990 to 3.085-in. at the mid-section of the arm 110. The increased section height H increases the strength of the arm 110, but does not increase the life enough to outlast the side plates.

Fourthly, the reduction of stress risers in the actuator arm 110 constitutes another part of the passive failure system and part of the arm's resistance to failure. Recalling in FIG. 1, the arms 20 of the prior art use pockets 34 and a pin 32 to hold the torsion spring 30. Recalling in FIG. 4, the arms 110 of the present invention use side portions 119, holes 118, and pins 160 to hold the leaf spring 150. Thus, the side portions 119 and hole 118 on the arm 110 in FIG. 8 is juxtaposed with the pocket 34, sidewalls 36, and indentations 38 on the prior art arm 20.

Use of the side portions 119 and hole 118 to retain the leaf spring (not shown) has dual benefits over the prior art. Machining of the actuator arm 110 is simplified. In addition, stress risers from a high stress region of the actuator arm 110 are reduced over the prior art arm 20. The side portion 119 is substantially smooth and defines the small hole 118 that holds the pin to maintain the biasing member between the arms of the assembly. Use of the smooth portion 119, small hole 118, and pin 160 substantially limits changes in lateral and longitudinal cross-sections of the arm 110. As is known in the art, failure in the prior art actuator arm 20 typically can begin at a point P between the cam end 22 and the pivot bore 26 and continues across the section of the prior art arm 20. The use of the pocket 34 aggravates this type of failure by creating a different cross-sectional area in a highly stressed region of the arm 20. Although the hole 118 is a stress riser in the arm 110 of the present invention, it is less of a stress riser than the pocket 34 or the step found in the prior art arm 20. Consequently, the life of the arm 110 and resistance to fatigue is increased.

Figure 9A:
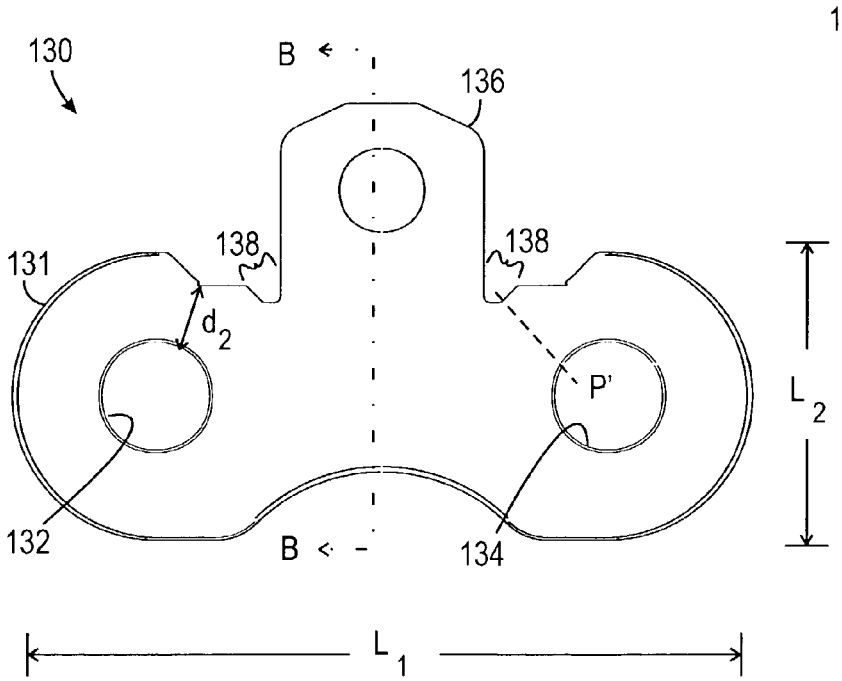
FIGS. 9A–B illustrate various views of a side plate of the actuator assembly of FIG. 4.
Figure 9B:
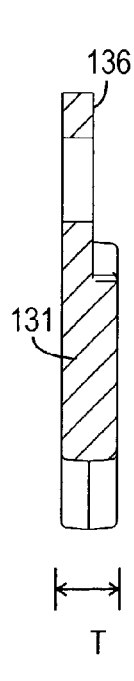

Lastly, the geometry, material, and hardness of the side plates 130 constitute part of the passive failure system and part of the side plates' resistance to failure. Referring to FIGS. 9A–B, an embodiment of a side plate 130 is illustrated in a number of views. The side plate 130 includes a main body portion 131 defining pivot apertures 132 and 134 and includes another portion 136 for attaching to a crimp tool (not shown). The side plate 130 has a longitudinal dimension $L_2$ of approximately 5.118-in. The main body 131 of the side plate 130 has a lateral dimension $L_2$ of approximately 2-in. and a thickness T of approximately 0.384-in.

In the present invention, the hardness of the side plate 130 is controlled relative to the size and shape of the pins 140 and the hardness of the actuator arms 110. The side plate 130 is heat treated to increase its life: however; the increase is controlled so that the side plate 130 preferably is the first component to fail in the assembly 100. The side plate 130 is composed of steel and is hardened and drawn to approximately 30–35 Rc to create a passive failure mode of the actuator assembly of the present invention. Bar stock can be used to form the side plate 130. Due to the inherent strength and grain alignment the forging process provides, forging can alternatively be used to form the side plate 130.

As is known in the art, an expected plane P' of failure for the side plate 130 occurs between one of the pivot apertures 132 or 134 and the edge of the main body portion 131 adjacent the attachment portion 136. The side plate 130 according to the present invention defines stepped, stress concentrators 138 where the attachment portion 136 connects to the main body portion 131. The smallest distance $d_2$ between the edge of the stress concentrators 138 and the pivot apertures 132 and 134 is approximately 0.4 to 0.5-in. The side plate 130 is configured to have the lowest fatigue level or life of the other components of the actuator assembly to ensure that the side plate 130 fails first above other modes of failure.

While the invention has been described with reference to the preferred embodiments, obvious modifications and alterations are possible by those skilled in the related art. Therefore, it is intended that the invention include all such modifications and alterations to the full extent that they come within the scope of the following claims or the equivalents thereof.

What is claimed is:

1. An improved assembly used with a displaceable member for actuating the assembly, comprising:

an arm pivotably disposed in the assembly and having an edge;

a side plate disposed parallel to a side of the arm; and a profile defined on the edge and capable of being engaged by the displaceable member, the profile comprising:

a first portion defining a radial contour of the edge, a second portion adjacent the first portion and defining a curved contour of the edge, and a third portion adjacent the second portion and defining a straight contour of the edges, wherein the curved contour of the second portion is defined by a $10^{th}$ order polynomial.

2. An arm used with a displaceable member for actuating the arm, comprising:

a first end;

an edge adjacent the first end; and a profile defined on the edge and capable of being engaged by the displaceable member, at least a portion of the profile being defined by a non-linear, non-radial contour of the edge;

wherein the non-linear, non-radial contour is defined by a $10^{th}$ order polynomial function.

3. The arm of claim 2, wherein the arm comprises a second end for crimping a fitting or for actuating a crimp ring.

4. The arm of claim 2, wherein the profile comprises:

a first portion being immediately adjacent the first end and defined by a radius;

a second portion being adjacent the first position and defined by the non-linear, non-radial contour; and a third portion being adjacent the second portion and defined by a linear function.

5. The arm of claim 4, wherein the first, second, and third portions are substantially contiguous with one another.

6. An assembly used with a displaceable member for actuating the assembly, the assembly comprising:

a plate defining a first aperture, the plate having a first hardness;

a pin disposed in the first aperture, the pin having a second hardness being equal to or greater than the first hardness; and an arm positioned adjacent the plate and defining a first pivot aperture for the pin, the arm rotatably disposed on the pin and capable of being rotated by engagement with the displaceable member, the arm having a third hardness, the third hardness being greater than the first hardness.

7. The assembly of claim 6, wherein the arm has a lateral dimension, the arm defining a maximum section height in the lateral dimension substantially at the first pivot aperture.

8. The assembly of claim 7, wherein the maximum section height is between 2.999 and 3.085 inches.

9. The assembly of claim 6, wherein the pivot pin has a diameter of approximately 19.08-mm.

10. The assembly of claim 6, wherein the plate has an edge defining a stress concentrator adjacent the first aperture.

11. The assembly of claim 10, wherein the stress concentrator comprises a plurality of steps.

12. The assembly of claim 6, wherein the first hardness is approximately 30 to 35 Rc.

13. The assembly of claim 12, wherein the third hardness is approximately 56 to 59Rc.

14. An assembly used with a displaceable member for actuating the assembly, the assembly comprising:

a plate defining a first aperture, the plate having first means for resisting failure up to a first level of fatigue;

a pin disposed in the first aperture, the pin having a second means for resisting failure up to a second level of fatigue, the second level being greater than the first level; and an arm positioned adjacent the plate and defining a first pivot aperture for the pin, the arm rotatably disposed on the pin and capable of being rotated by engagement with the displaceable member, the arm having a third means for resisting failure up to a third level of fatigue, the third level being greater than the first level.

15. An assembly used with a displaceable member for actuating the assembly, the assembly comprising:

a first arm disposed in the assembly and having a first side, the first side defining a first hole;

a second arm disposed in the assembly and having a second side;

a biasing member disposed between the arms comprising:

a first portion being adjacent the first side, and a second portion being adjacent the second side; and a first pin disposed in the first hole and engaging the first portion to hold the biasing member between the arms.

16. The assembly of claim 15, wherein the second arm further defines a second hole in the second side, and wherein the assembly further comprises a second pin disposed in the second hole and engaging the second portion to hold the biasing member between the arms.

17. The assembly of claim 15, wherein the biasing member is a leaf spring.

* * * * *